US009861184B2

(12) United States Patent
VanHeusen

(10) Patent No.: US 9,861,184 B2
(45) Date of Patent: Jan. 9, 2018

(54) HOLSTER FOR ARTICLES WITH RESILIENT ASSEMBLY

(71) Applicant: Wilder Tactical Group, LLC, Mauldin, SC (US)

(72) Inventor: Josh VanHeusen, Fairview, NC (US)

(73) Assignee: Wilder Tactical Group, LLC, Mauldin ( * ) Notice: Subject to any disclaimer, the term of this patent is extended or adjusted under 35 U.S.C. 154(b) by 0 days.

(21) Appl. No.: 15/001,294

(22) Filed: Jan. 20, 2016

(65) Prior Publication Data

US 2016/0209163 A1 Jul. 21, 2016

Related U.S. Application Data

(60) Provisional application No. 62/105,291, filed on Jan. 20, 2015.

(51) Int. Cl.

| | |
|---|---|
| ***F41C 33/02*** | (2006.01) |
| ***A45F 5/02*** | (2006.01) |
| ***A45F 5/00*** | (2006.01) |
| ***F42B 39/02*** | (2006.01) |

(52) U.S. Cl.

CPC ..... *A45F 5/02* (2013.01); *A45F 5/00* (2013.01); *F41C 33/0209* (2013.01); *F42B 39/02* (2013.01); *A45F 2200/0591* (2013.01)

(58) Field of Classification Search

CPC ..... F41C 33/02–33/029; F42B 39/02; F42B 39/20; Y10S 224/911–224/912

USPC ..... 224/192–193, 198, 238, 243, 911–912, 224/148.5–148.6, 250, 436–439, 563; D3/222–223, 218; 206/3

See application file for complete search history.

(56) References Cited

U.S. PATENT DOCUMENTS

| | | | | | |
|---|---|---|---|---|---|
| 4,044,932 | A * | 8/1977 | Harris, Jr. | A45F 5/02 | 131/260 |
| D418,119 | S * | 12/1999 | Rowell | D3/218 | |
| 6,029,872 | A * | 2/2000 | Ellington | A01K 97/10 | 224/251 |
| D437,111 | S * | 2/2001 | Bergh | D3/218 | |
| 7,780,048 | B2 * | 8/2010 | Howell | A41D 13/0012 | 224/196 |
| 7,845,527 | B1 * | 12/2010 | McMillan | B26B 29/02 | 224/232 |
| D772,368 | S * | 11/2016 | Evans | D22/108 | |
| 2011/0107645 | A1 * | 5/2011 | Faifer | F41A 9/63 | 42/90 |
| 2014/0262842 | A1 * | 9/2014 | Beck | B65D 21/08 | 206/3 |
| 2016/0003598 | A1 * | 1/2016 | Gadams | F42B 39/02 | 206/3 |
| 2016/0100678 | A1 * | 4/2016 | Evans | A45F 5/00 | 224/231 |
| 2017/0099934 | A1 * | 4/2017 | Evans | A45F 5/02 | |

* cited by examiner

*Primary Examiner* — Scott McNurlen

(74) *Attorney, Agent, or Firm* — McNair Law Firm, P.A.; Douglas W. Kim

(57) ABSTRACT

This invention provides for the ability to holster articles and includes a front panel, a rear panel and a pivot and cavity defined by the front panel and rear panel. A resilient member can extending through opening in the front panel and rear panel operatively associated with the front panel and rear panel rear panel so that when an article is inserted into the cavity, tension is placed on the article securing it into the cavity. Multiple cavities can be included so that multiple articles can be carried. The invention can be attached by a mounting assembly.

10 Claims, 7 Drawing Sheets

HOLSTER FOR ARTICLES WITH RESILIENT ASSEMBLY

1. FIELD OF THE INVENTION

The present disclosure relates generally to holsters. In particular, holsters configured to have a resilient retention assembly for supporting articles, such as firearms, magazines and the like, for efficient storage and removal.

2. BACKGROUND OF THE INVENTION

Known storage devices are not entirely satisfactory for the range of applications in which they are employed. For example, many existing devices store articles in ways that are difficult to access quickly and easily. For example, many conventional devices define non-rigid structures that provide little structural support when a user removes a stored article. Tourniquet removal may be a clunky process as a result.

For example, many conventional tourniquet storage devices define cloth pouches that substantially envelop stored tourniquets. The cloth construction provides insufficient stability when a user attempts to retrieve the article from the pouch. As a result, users may tumble the article during retrieval. In tactical situations, small delays like this may result in injury or death.

Further, the prevalence of standard article designs in tactical applications, such as the military, provides an opportunity to tailor article storage devices to these designs and improve article storage and retrieval. Conventional designs fail to meet these needs.

Therefore, it is an object of the present invention to provide for an article holster that improve upon and advance the design or known article storage devices.

SUMMARY OF THE INVENTION

The above objectives are accomplished according to the present invention by providing an article holster comprising: a front panel having a front panel right wall, front panel lower wall and front panel left wall defining a front portion of a cavity; a rear panel having a rear panel right wall, rear panel lower wall and rear panel left wall defining a rear portion of the cavity wherein the rear panel is configured to receive the front panel so that the rear panel right wall, rear panel lower wall and rear panel left wall overlap the a front panel right wall, front panel lower wall and front panel left wall further defining the cavity; a front panel lower wall having a rear edge included in the front panel and configured to contact the interior wall of the rear panel defining a pivot; a front panel lower opening defined in the front panel lower wall and positioned to be forward the front edge of the rear panel lower wall when the front panel is received into the rear panel; a rear panel lower opening defined in the rear panel lower wall; a front panel right first upper opening, a front panel right second upper opening, a front panel right top upper opening, a front panel left first upper opening, a front panel left second upper opening, a front panel left top upper opening defined in the front panel; a rear panel right first upper opening, a rear panel right second upper opening, a rear panel right third upper opening, a rear panel right top upper opening, a rear panel left first upper opening, a rear panel left second upper opening, a rear panel left third upper opening, a rear panel left top upper opening defined in the rear panel; and, a resilient member configured to extend into the rear panel lower opening, into the front panel lower opening, out the front panel right first upper opening, into the rear panel right first upper opening, out of the rear panel right second upper opening, into the front panel right second upper opening, out of the front panel right top opening, into the rear panel right third upper opening, out of the rear panel right top opening, extend around the rear of the upper portion of the rear panel, into the rear panel left top opening, out of the rear panel right third upper opening, into the front panel left top opening, out of the front panel left second opening, into the rear panel left second upper opening, out of the rear panel left first upper opening, into the front panel left first opening, out of the front panel lower opening and out of the rear panel lower opening; and, the front panel, rear panel and resilient member are configured so that when an article is inserted into the cavity opening, the diameter of the cavity opening increases as the article is inserted, the front panel and rear panel rotate at the pivot and tension is placed on the article securing it into the cavity by the resilient member cooperatively associated with the front panel and the rear panel.

The invention can include a shock cord having an elastic core and braided sheath. A cord lock can be attached to ends of the resilient member extending out of the rear panel. Rear openings can be defined in the rear wall of the rear panel for attaching a mounting assembly to the rear panel. The mounting assembly can be a loop, clip, molle clip, hook and loop fastener, or any combination of these.

A ridge can be defined in the front panel. The ridge can be configured to receive the windless from a tourniquet. A securing strap fixed to the rear panel, extending over the opening of the cavity and releasably attached to the front panel. A second article holster having a second rear panel that is attached to the exterior of the front panel. A plate can be attached to the interior side of the rear panel.

The invention can include a front panel having front panel walls on three sides defining a front portion of a cavity; a rear panel having a rear panel walls defining a rear portion of the cavity wherein the rear cavity is configured to receive the front panel walls further defining the cavity; a pivot defined between the lower portion of the front panel and the rear panel where the front panel; a front panel lower opening defined in the front panel walls position to be forward the rear panel walls when the front panel is received into the rear panel; a rear panel lower opening defined in the rear panel walls; a set of front panel openings defined in the front panel; a set of lateral rear panel opening defined in the rear panel; a resilient member operatively associated with the rear panel lower opening, front panel lower opening, set of front panel openings and set of rear panel openings so that when an article is inserted into the cavity, tension is placed on the article securing it into the cavity.

The article of claim 11 wherein the set of front panel openings and a set of lateral rear panel openings are configured to allow upper portion of the cavity to expand greater than the lower portion of the cavity when an article is inserted. A flared top edge can be included on the front panel and a feed ramp can be defined in the top edge of the rear panel.

The invention can include a front panel defining a front portion of a cavity; a rear panel defining a rear portion of the cavity when the front panel is received in the rear panel; a pivot defined between the lower portion of the front panel and the rear panel; and, a resilient member extending through opening in the front panel and rear panel operatively associated with the front panel and rear panel rear panel so that when an article is inserted into the cavity, tension is placed on the article securing it into the cavity.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DETAILED DESCRIPTION OF THE INVENTION

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits, and advantages of the present invention will be apparent from this summary and certain embodiments described below, and will be readily apparent to those skilled in the art. Such objects, features, benefits, and advantages will be apparent from the above in conjunction with the accompanying examples, data, figures, and all reasonable inferences to be drawn therefrom, alone or with consideration of the references incorporated herein.

Figure 1:
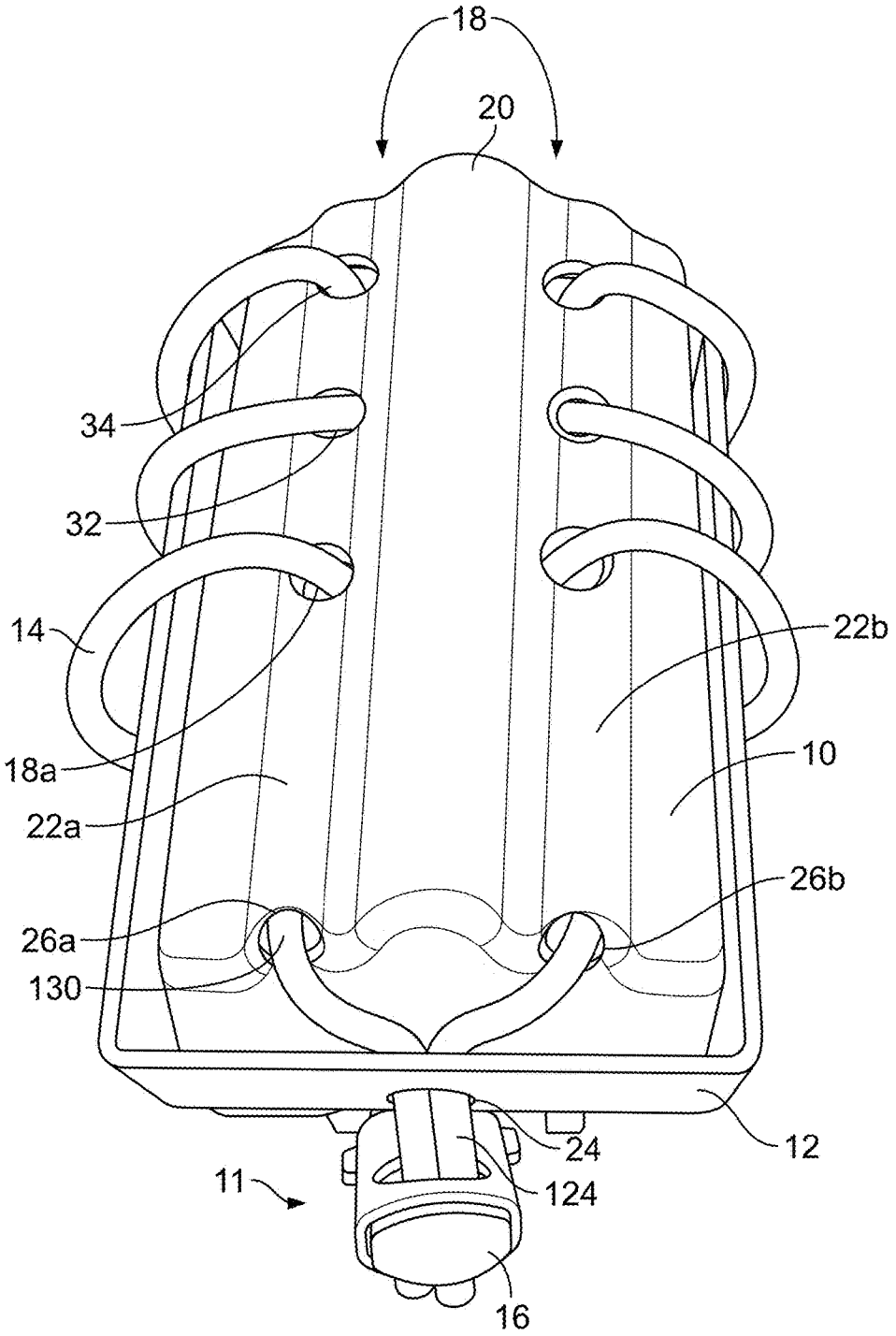
FIG. 1 is a front perspective view of aspects of the invention.

Referring to FIG. 1, one embodiment of the article holster is shown configured to receive a generally rectangular article such as an ammunition magazine. A front panel 10 is received into a rear panel 12 and secured together by resilient member 14. The resilient assembly 14 can include a resilient member that can be an elastic cord in one embodiment. The resilient member in one embodiment can include an elastic core surrounded with a braided sheath. While the braided sheath may not be elastic itself, the braids allow it to expand and contract with the elastic cord. A cord lock 16 can be included in the resilient assembly and attached to the two ends of the resilient member that extend out of a rear panel lower opening 124. The front panel can include a plurality of openings such as shown generally as 18 for receiving the resilient member.

The front panel can include front panel can include front panel lower openings such as front panel right lower opening 26*a* and front panel left lower opening 26*b*. The front panel can include a front panel right first upper opening 18*a*, front panel right second upper opening 32, front panel right third upper opening 34, a front panel left first upper opening 18*b*, front panel left second upper opening 18*c*, and front panel left third upper opening 18*d*.

The front panel can include a ridge 20 extending outward from the front panel. The ridge can be configured to receive a windlass of a tourniquet in one embodiment where the article being inserted into the windlass is a tourniquet. The front panel can include secondary ridges 22*a* and 22*b* which extend outwardly from the front panel. The ridges can be used to further secure articles in the holder.

In one embodiment, the lower openings are arranged to be disposed forward the rear panel lower wall and the rear panel lower wall opening. When the resilient member is received into the front panel lower openings and rear panel lower opening and tensioned, the lower portion of the front panel and lower portion of the rear panel are biased together to form a pivot shown generally as 130 between the rear edge of the front panel lower wall and the interior side of the rear panel.

Figure 2:
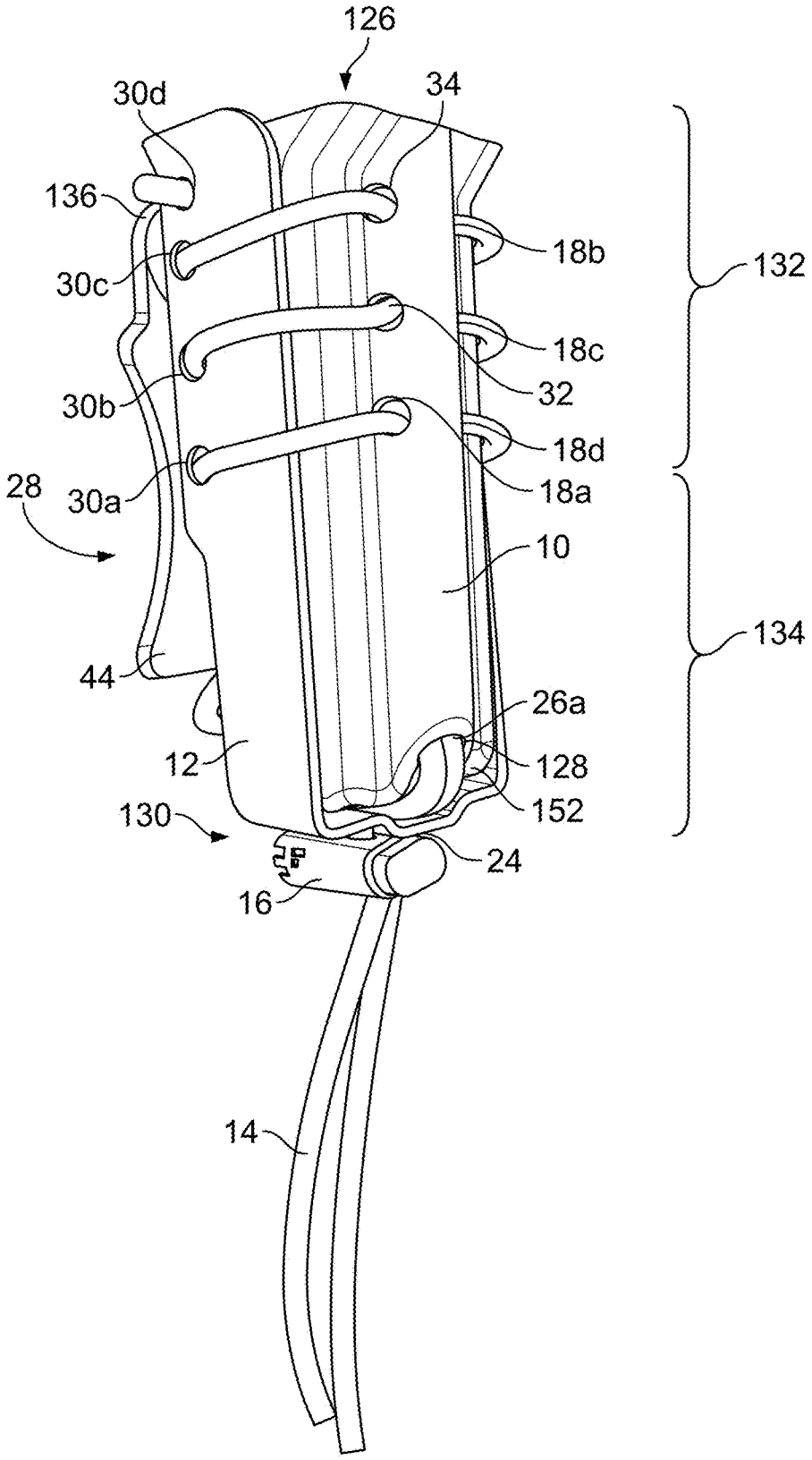
FIG. 2 is a side view of aspects of the invention.

Referring to FIG. 2, the front panel 10 is shown received into the rear panel 12 so that the walls of the front panel and the walls of the rear panel overlap within the cavity. The front panel walls panel that partially define a cavity and received into the real panel walls that partially define a cavity to define a cavity having a cavity opening 126. The front panel can include a front panel lower wall 128 that include a rear edge that can contact the interior rear wall of the rear panel to form a pivot shown generally as 130. The pivot allows the upper portion of the cavity 132 to expand more than the lower portion of the cavity 134 when an article is inserted into the cavity. The rear panel can include a rear well 136 having a mounting assembly 44 attached to the rear panel rear wall. The mounting assembly can be a belt loop mounting assembly marketed as the Tek-Lok®, loop, clip, molle clip, hook and loop fastener, and any combination of these. The mounting assembly can be configured to attach the article holster to a belt, waistband, strap, molle system, and the like.

In one embodiment, the resilient member can be configured to extend into the rear panel lower opening 24, into the front panel lower opening 128, out the front panel right first upper opening 18*a*, into the rear panel right first upper opening 30*a*, out of the rear panel right second upper opening 30*b*, into the front panel right second upper opening 32, out of the front panel right top opening 34, into the rear panel right third upper opening 30*c*, out of the rear panel right top opening 30*d*, extend around the rear of the upper portion of the rear panel, into the rear panel left top opening, out of the rear panel right third upper opening, into the front panel left top opening 18*b*, out of the front panel left second opening 18*c*, into the rear panel left second upper opening, out of the rear panel left first upper opening, into the front panel left first opening 18*d*, out of the front panel lower opening 128 and out of the rear panel lower opening 24; and, By using a resilient member, the front and back panels can extend away from each other if force is applied between the panels such as by inserting an article with the resilient member assisting in biasing the front and back panel together to secure the article in the cavity.

The front panel can include a flared top edge at the top of the front panel to assist with the insertion of an article into the cavity. The rear panel can include a feed ramp at the top of the rear panel to assist with the insertion of an article into the cavity.

Figure 3:
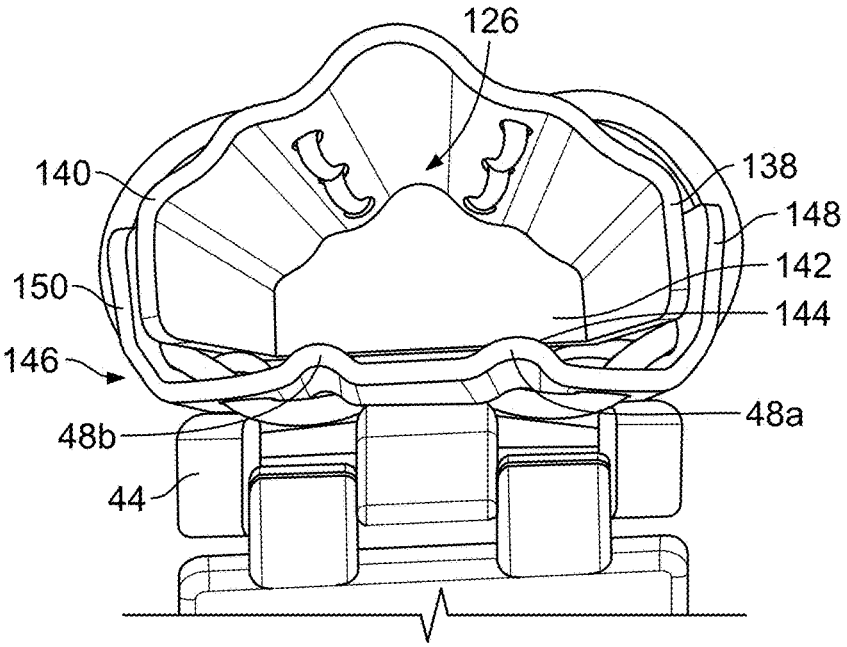
FIGS. 3 through 5 are top down views of aspects of the invention.
Figure 4:
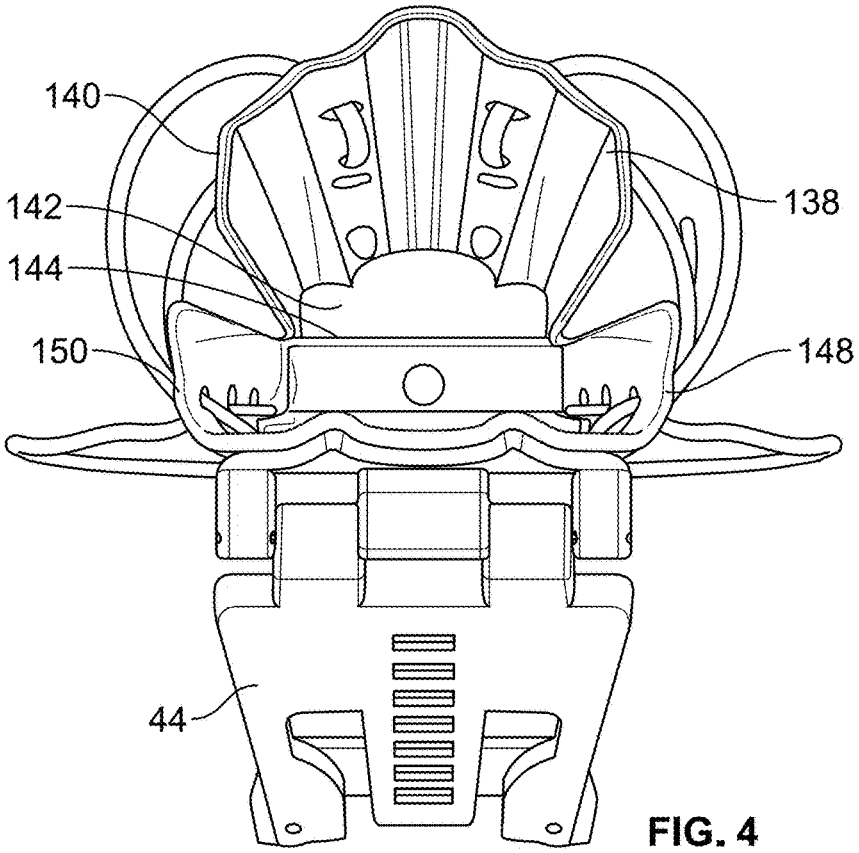
Figure 5:
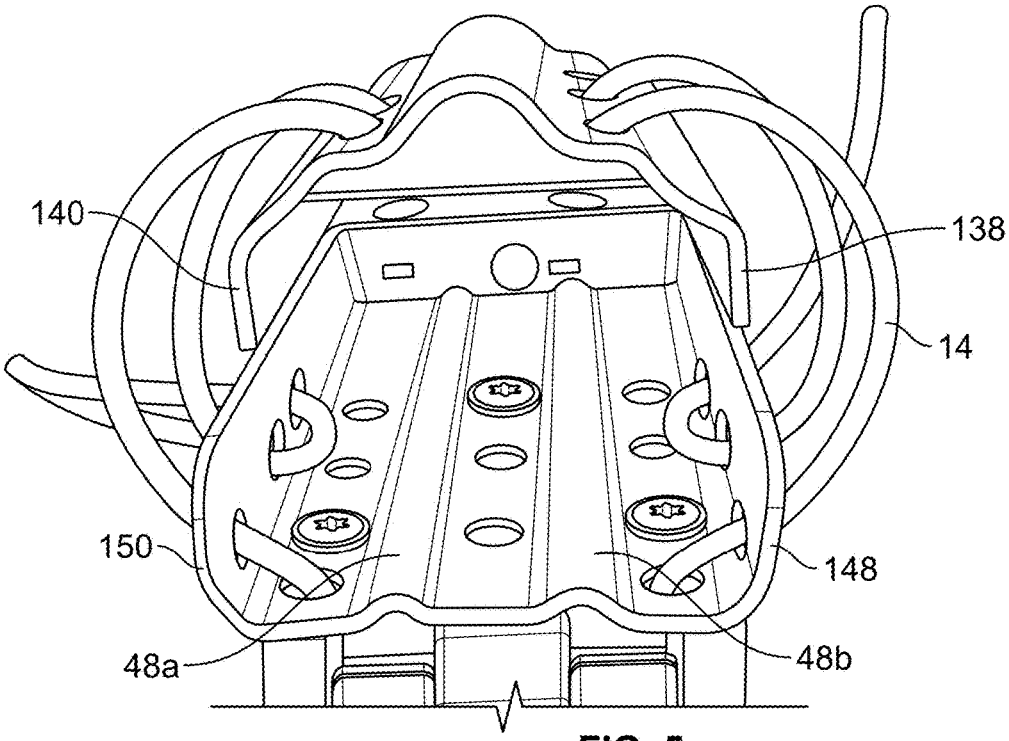

Referring to FIGS. 3 through 5, the cavity opening allows a view in the interior of the holster. The front panel include walls including the front panel right wall 138, front panel left wall 140 and front panel lower wall 142. The front panel lower wall can include a rear edge 144 that can contact the interior of the rear panel to form a pivot 146. The rear panel can include a rear panel right wall 148, rear panel left wall 150 and rear panel lower wall 152 (FIG. 2). Internal ridges 48*a* and 48*b* can be included in the rear panel to prevent the article from unnecessarily contacting the resilient member when the article is inserted into and removed from the cavity. Additionally the internal ridges can assist with placing tension on the article when the article is placed in the cavity.

Figure 6:
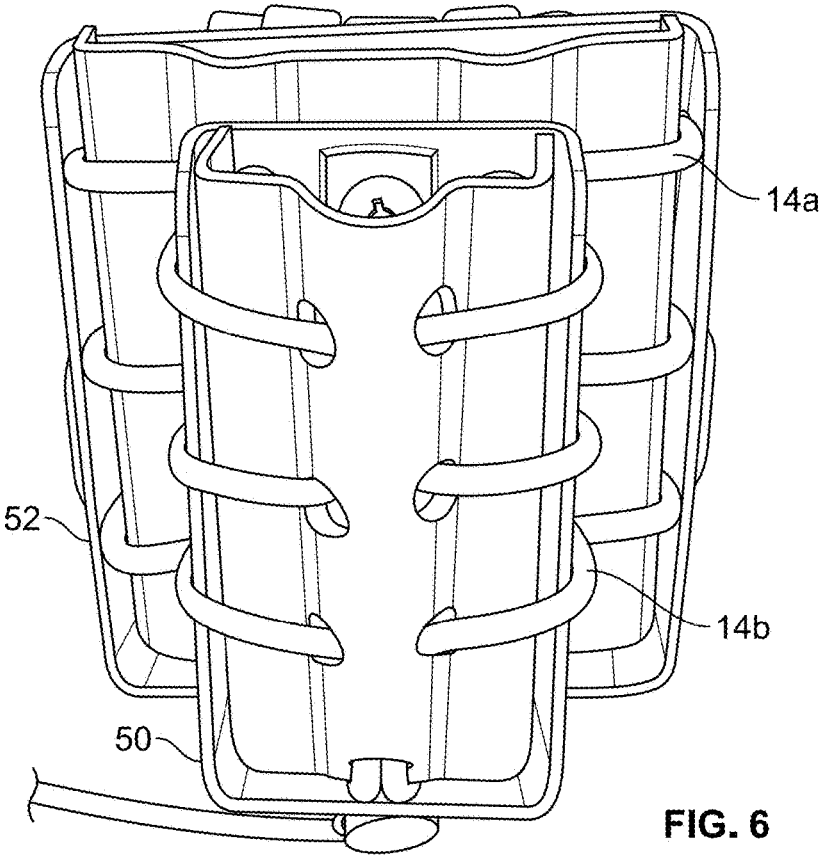
FIG. 6 is a front view of aspects of the invention.

Referring to FIG. 6, another embodiment is shown having a front holster 50 and a rear holster 52. The rear panel of the front holster is attached to the front panel of the rear holster. The front holster has a cavity with a volume less than that of the rear holster. In one embodiment, the rear holster is about half the volume of the front holster. The rear holster is attached to a mounting assembly. In one embodiment a first resilient member 14*a* is used for holster 52 and a second resilient member 14*b* is used for holster 50. In one embodiment, a single resilient member if used for holster 50 and 52.

Figure 7:
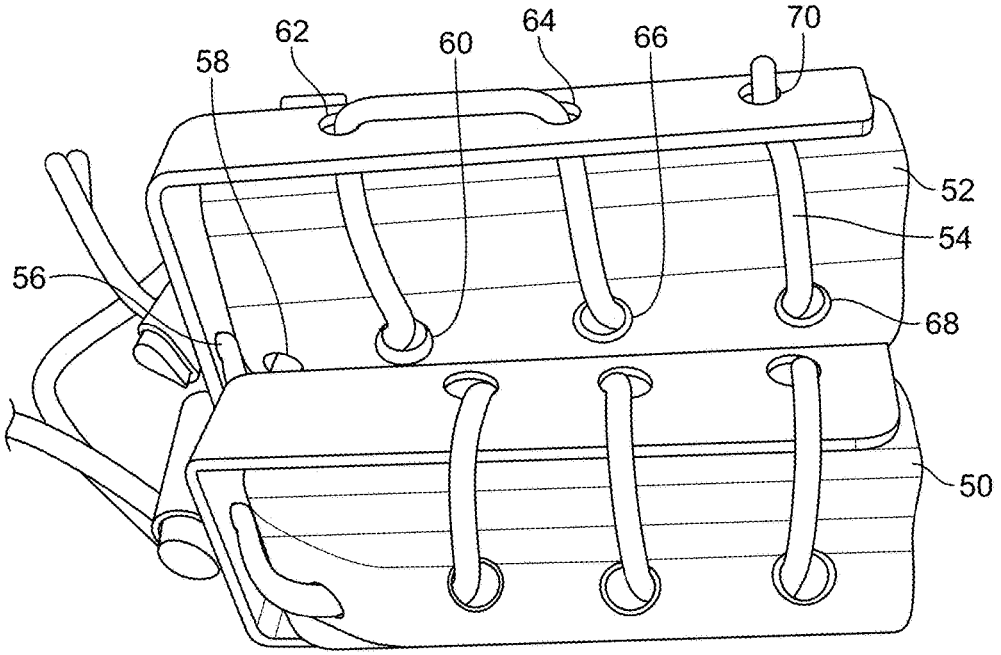
FIG. 7 is a side view of aspects of the invention.

Referring to FIG. 7, the front holster 50 is mounted in the center of the front panel of the rear holster. The resilient member 54 of the rear holster travels through an opening 56 in the bottom of the front panel and extends upward and external to the front panel into an opening 58 in the front panel. The resilient member travels internal to the front panel and extends outward through opening 60. The resilient member travels across the front panel and between the front panel and rear panel and through opening 62 in the rear panel. The resilient member travels along the outer side of the rear panel and into opening 64 above opening 62. The resilient member travels between the front and back panels and into opening 66 in the front panel above opening 60. The resilient member travels internal to the front panel in the cavity of the rear holster and out opening 68. The resilient member can travel between the front and rear panel and through opening 70, around the back of the rear panel and into an opening that is a mirror to opening 70. The resilient travels a path that is a mirror to the path on the other side and through the bottom opening 56. In one embodiment, the inner wall of the rear panel of the rear holster includes recesses to accommodate mounting hardware for the mounting assembly attached to the rear panel of the rear holster.

Figure 8:
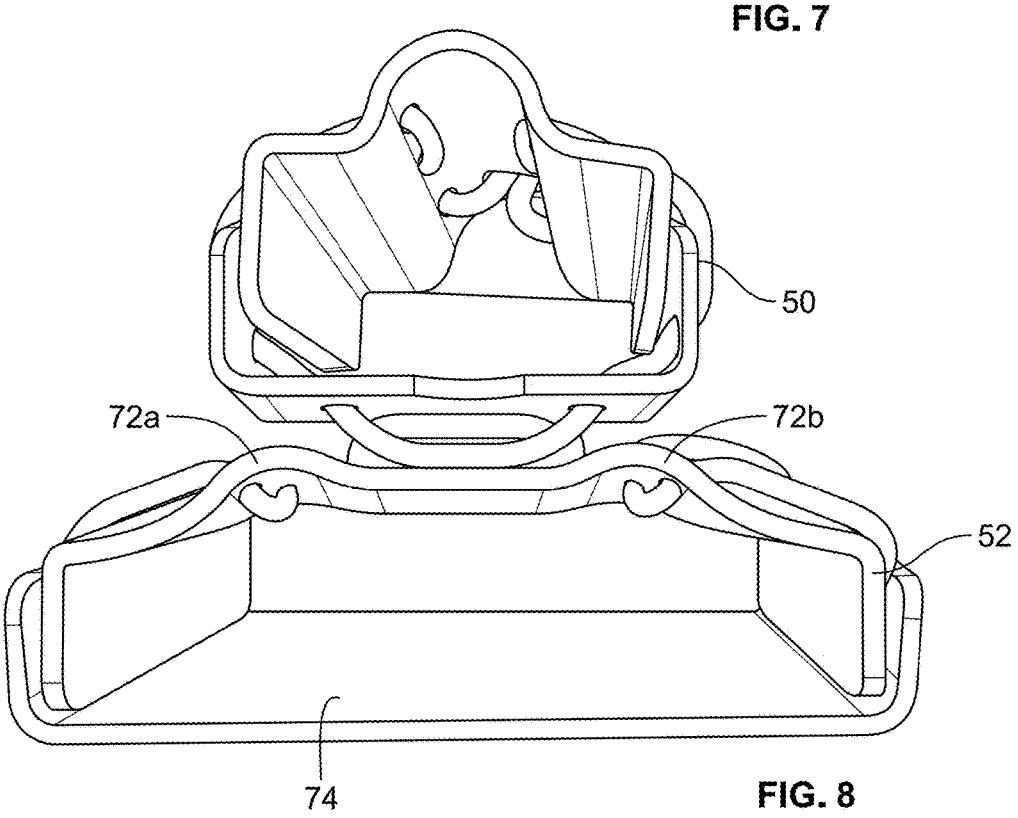
FIG. 8 is a top view of aspects of the invention.

Referring to FIG. 8, the rear holster front panel can include two ridges 72*a* and 72*b* to assist in securing articles placed in the holster. The rear inner wall 74 of the rear holster rear panel can be smooth. This configuration allows the securing of two articles at the same time with both being resiliently held in the holsters without increasing the footprint of the rear holster.

Figure 9:
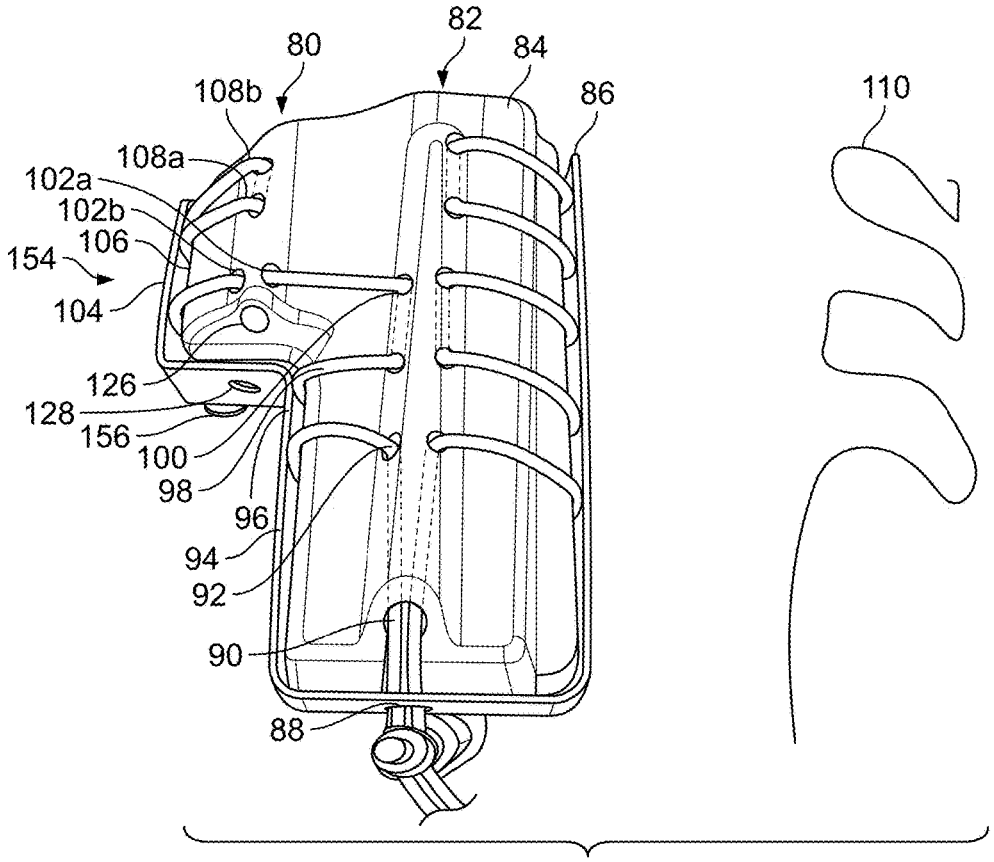
FIG. 9 is a front perspective view of aspects of the invention.

Referring to FIG. 9, another embodiment is shown having a first holster cavity 80 and a second holster cavity 82. In this configuration, two articles can be carried such as a tourniquet in the second cavity and a flashlight in the first cavity. A front panel 84 is secured to a rear panel 86 by a resilient member. The resilient member can travel through the bottom opening, travel between the front and rear panels into the front panel opening 90, internal to the front panel, for example, behind the front panel in the cavity, and out through opening 92. The resilient member can travel between the front and rear panels into opening 94 in the side of rear panel, upward along the side of the rear panel and into opening 96. The resilient member can be received into opening 98 on the front panel, travel internal to the front panel and exit through opening 100. The resilient member can travel through openings 102*a* and 102*b*, out opening 104 in the rear panel and upward along the side of the rear panel into opening 106. The resilient member can travel into opening 108*a* in the front panel and out through 108*b* and back through 106 and around the back of the rear panel. The resilient member can then travel through opening in the opposite side of the front and rear panels in an alternating pattern as shown by path 110. A trigger guard area 154 can be defined between the front panel and the rear panel allowing a trigger housing of a firearm inserted in the cavity to be covered when holstered. The front panel can include an opening 126 at the bottom of one side of the front panel. The rear panel can include a corresponding opening 128 under the opening 126. A plate securing member 156 can be included and attached to the rear panel. The plate securing member can allow the rear panel to be attached to a mounting assemble and allow the tension of the trigger guard area to be varied.

Figure 10:
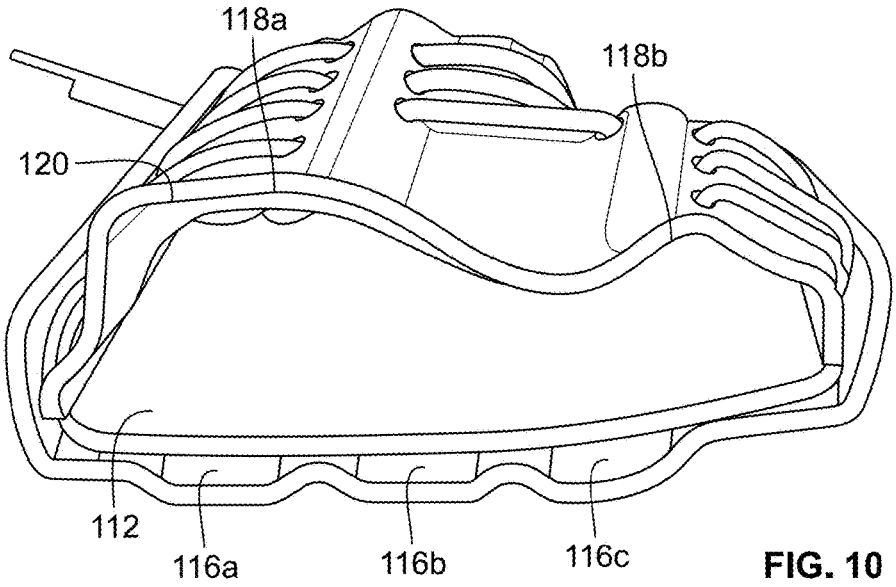
FIG. 10 is a top view of aspects of the invention.

Referring to FIG. 10, on embodiment includes a plate 112 disposed in the cavity 114 defined between the front panel and the rear panel. The front panel and the internal plate are disposed between the side walls of the rear panel. Slots 116*a* through 116*c* can be included for receiving mounting hardware. Ridges 118*a* and 118*b* can be included in the front panel and extend outward. The top edge 120 or a top portion of the front panel can be contoured, such as with a flared top edge, for assisting in inserting articles into the holster.

Figure 11:
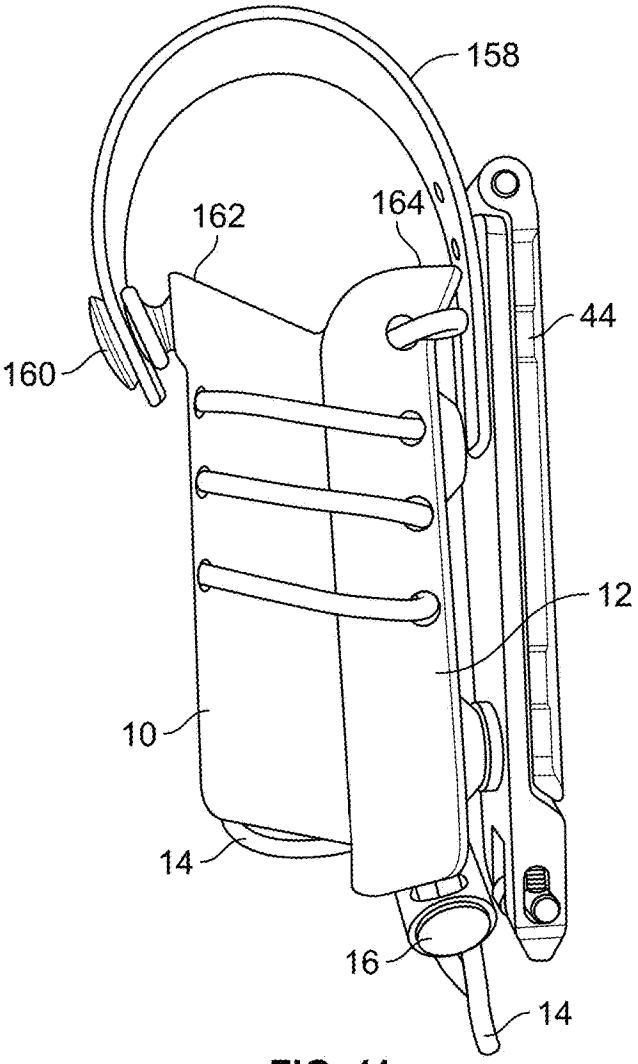
FIG. 11 is a side view of aspects of the invention.

Referring to FIG. 11, a securing strap 158 can be attached to the rear panel, extend over the opening of the cavity and be releasably attached to the front panel with strap connector 160. When released from the front strap, the cavity is accessible for an article to be inserted. When the strap is connected to the front panel, the article can be further secured into the cavity. The front panel can include a flared top edge 162 to assist with the article being inserted into the cavity. The rear panel can include a feed ramp 164 to assist with the article being inserted into the cavity.

Figure 12:
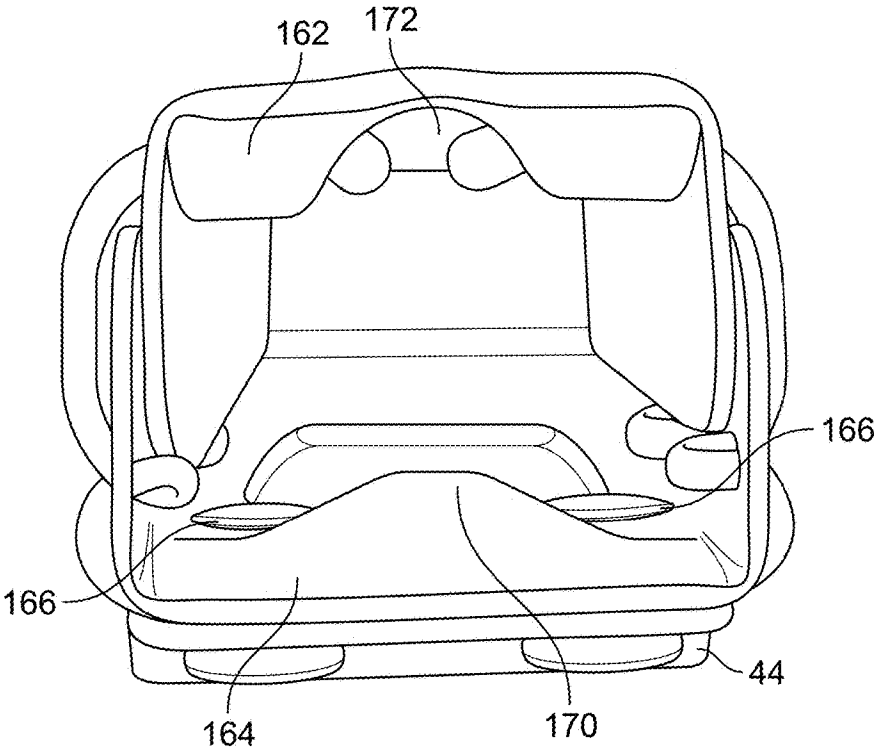
FIG. 12 is a top view of aspects of the invention.

Referring to FIG. 12, the cavity and the cavity opening are shown. An front concave area 172 can be included in the front panel to prevent or reduce the article coming in contact with the resilient member. The resilient member can be disposed with in the front concave area. A rear convex area 170 can be included in the rear panel to prevent or reduce the article coming in contact with the resilient member. The resilient member can be disposed in an area defined by the rear panel wide walls and the convex area laterally at the interior of the rear panel. The walls of the front panel can be configured to define an area between the edge of the rear wall and the internal rear side of the rear panel to define a space where the resilient member can be disposed. Openings can be defined in the rear of the rear panel configured to attach the mounting assembly 44. The opening can received a bolt and nut assembly to secure the mounting assembly to the rear panel.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. An article holster comprising:

a front panel having a front panel right wall, front panel lower wall, and front panel left wall defining a front portion of a cavity;

a rear panel having a rear panel right wall, rear panel lower wall, and rear panel left wall defining a rear portion of the cavity wherein the rear panel is configured to receive the front panel so that the rear panel right wall, rear panel lower wall, and rear panel left wall overlap the front panel right wall, front panel lower wall, and front panel left wall further defining the cavity;

the front panel lower wall having a rear edge configured to contact an interior wall of the rear panel defining a pivot;

a front panel lower opening defined in the front panel lower wall and positioned to be forward of the rear edge of the rear panel lower wall when the front panel is received into the rear panel;

a rear panel lower opening defined in the rear panel lower wall;

a front panel right first upper opening, a front panel right second upper opening, a front panel right top upper opening, a front panel left first upper opening, a front panel left second upper opening, and a front panel left top upper opening defined in the front panel;

a rear panel right first upper opening, a rear panel right second upper opening, a rear panel right third upper opening, a rear panel right top upper opening, a rear panel left first upper opening, a rear panel left second upper opening, a rear panel left third upper opening, a rear panel left top upper opening defined in the rear panel; and, a resilient member configured to extend into the rear panel lower opening, into the front panel lower opening, out the front panel right first upper opening, into the rear panel right first upper opening, out of the rear panel right second upper opening, into the front panel right second upper opening, out of the front panel right top upper opening, into the rear panel right third upper opening, out of the rear panel right top upper opening, extending around the rear of an upper portion of the rear panel, into the rear panel left top upper opening, out of the rear panel left third upper opening, into the front panel left top upper opening, out of the front panel left second upper opening, into the rear panel left second upper opening, out of the rear panel left first upper opening, into the front panel left first upper opening, out of the front panel lower opening and out of the rear panel lower opening; and, the front panel, rear panel, and resilient member are configured so that when an article is inserted into the cavity opening, a diameter of the cavity opening increases as the article is inserted, the front panel and rear panel rotate at the pivot and tension is placed on the article securing it into the cavity by the resilient member cooperatively associated with the front panel and the rear panel.

2. The article of claim 1 wherein the resilient member is a shock cord having an elastic core and braided sheath.

3. The article of claim 1 including a cord lock attached to ends of the resilient member extending out of the rear panel lower opening.

4. The article of claim 1 including a rear opening defined in the rear wall of the rear panel for attaching a mounting assembly to the rear panel.

5. The article of claim 4 wherein the mounting assembly is taken from the group consisting of a loop, clip, molle clip, hook and loop fastener, and any combination of these.

6. The article of claim 1 including a ridge defined in the front panel.

7. The article of claim 1 wherein the ridge is configured to receive a windlass from a tourniquet.

8. The article of claim 1 including a securing strap fixed to the rear panel, extending over the opening of the cavity and releasably attached to the front panel.

9. The article of claim 1 including a second article holster having a second rear panel that is attached to the exterior of the front panel.

10. The article of claim 1 including a plate attached to the interior wall of the rear panel.

* * * * *